United States Patent [19]

Brannen

[11] Patent Number: 4,570,801

[45] Date of Patent: Feb. 18, 1986

[54] DOCUMENT HANDLING MACHINE

[76] Inventor: Ralph L. Brannen, 1038½ S. Orange Dr., Los Angeles, Calif. 90019

[21] Appl. No.: 591,818

[22] Filed: Mar. 21, 1984

[51] Int. Cl.[4] ..... B07C 5/00

[52] U.S. Cl. ..... 209/534; 209/551; 221/21; 271/4; 271/262; 271/303; 414/330

[58] Field of Search ..... 271/4, 6, 303, 126, 271/150, 149, 162, 164, 262, 263; 414/330, 28, 32, 43, 901; 221/21, 13, 231, 227; 194/4 C; 209/551, 534, 656, 657; 235/98 C

[56] References Cited

U.S. PATENT DOCUMENTS

| | | | |
|---|---|---|---|
| 3,966,193 | 6/1976 | Storace et al. | 271/126 |
| 4,121,716 | 10/1978 | Luperti et al. | 271/263 |
| 4,179,031 | 12/1979 | Ward | 209/657 |
| 4,221,376 | 9/1980 | Handen et al. | 271/149 |

*Primary Examiner*—Bruce H. Stoner, Jr.
*Assistant Examiner*—John A. Carroll

[57] ABSTRACT

A document and currency handling machine in which bills to be handled are loaded in a cartridge having a first endless belt with a pusher plate which is spring biased towards the sheet-by-sheet feeder in the machine by a spiral spring coupled between the first endless belt and the shaft of one roller over which the first belt passes, so as to assure constant pressure by the pusher plate throughout its travel; a second endless belt, receiving separated bills from the sheet-by-sheet feeder, passes them by a sensor which detects defective bills and activates a diverter which diverts such defective bills into a reject tray, the good bills passing to an output stacker which, when the predetermined number of bills has been received by it, pivots to permit easy removal of the good bills.

6 Claims, 3 Drawing Figures

DOCUMENT HANDLING MACHINE

BACKGROUND OF THE INVENTION

1. Field of the Invention

This invention relates to document and currency handling machines and, more particularly, to document handling machines with batching and sorting capabilities.

2. Prior Art

There have existed in the document and currency handling art machines in which sheet-by-sheet feeding of bills or documents which are vertically oriented is accomplished, in part, by a pusher plate which is biased towards the bills by a helical spring of a length approximating the length of the maximum number of bills in a stack to be handled. If it is desired, as here, to utilize a cartridge in which the bills have been stacked for easy insertion into the document handling machine, the length of the cartridge becomes very long if a helical spring is utilized. Further, because of inherent helical spring characteristics, towards the end of the feeding process when there are only a few bills left in the stack of vertically oriented bills or documents, the pressure from the pressure plate biased by the helical spring falls to a point where the bills or documents are not fed smoothly into the sheet-by-sheet mechanism, as a result of which jamming conditions and other undesirable conditions may arise. Further, in a document handling machine where such bills or documents are to be sorted as to fit and unfit or real or counterfeit it has been a practice in the past to stop the feeding of the machine with the counterfeit or defective bill as the last bill in the output or stacker from the document handling machine and then, manually, to remove the defective bill from the stacker. This is a slow process. With the advent of the ATM machines the need for pre-determined batches of bills which can be wrapped and supplied to ATM machine owners and, subsequently, to the users of those machines, it is essential that high-speed sorting and batching be achieved without any manual steps other than the original loading of unseparated bills into the handling machine and removal of a batch of a predetermined number and with assured quality from the machine at the end of the batching process.

Therefore, it is a first object of this invention to overcome the various problems of prior art devices, as described hereinbefore.

It is a further object of this invention to provide a document handling machine in which the feeding of documents out of the input stack is assured of being consistent and free of jamming despite the position of a bill or document in the input stack.

It is an additional object of this invention to provide a document or currency handling machine which automatically segregates defective documents or bills from good bills without stopping the action of the machine to manually remove a bad document or bill.

SUMMARY OF THE INVENTION

A document and currency handling machine is provided with an improved document input mechanism and a unique defective-document diverter which makes the overall machine faster and more reliable for sorting fit from unfit bills or documents, such machine being free from input jamming of the bills. The documents or bills to be handled are placed with a generally vertical individual orientation in an input tray or cartridge which comprises, among other things, an endless belt carrying a pusher plate which pushes the bills towards the sheet-by-sheet feeder. Instead of a conventional helical spring urging the pusher plate towards the bills and urging the bills into the feed, a spiral spring is coupled between the endless belt and the shaft of one roller over which the endless belt passes, such spiral spring urging the endless belt, which carries the pusher plate, towards the input stack of bills at a constant pressure throughout the travel of the pusher plate, thus assuring no slippage of the bills as they approach the single-sheet feeder. The bills enter the feeder in uniform fashion without jamming.

Another endless belt transports the separated bills which have been received from the sheet-by-sheet feeder, past a sensor, such as a density sensor, and, if the bill exhibits the wrong density, or other characteristic being checked, a signal is developed which activates a diverter element and diverts the defective bill into a reject tray. When the pre-determined number of good bills has appeared in the output stacker, the stacker pivots, permitting the removal of the batch of bills of pre-determined quantity and quality from the document and currency handling machine according to this invention.

BRIEF DESCRIPTION OF THE DRAWINGS

This invention can be best understood by reviewing the description which follows in conjunction with the drawings herein, in which.

DETAILED DESCRIPTION OF THE PREFERRED EMBODIMENT

Figure 1:
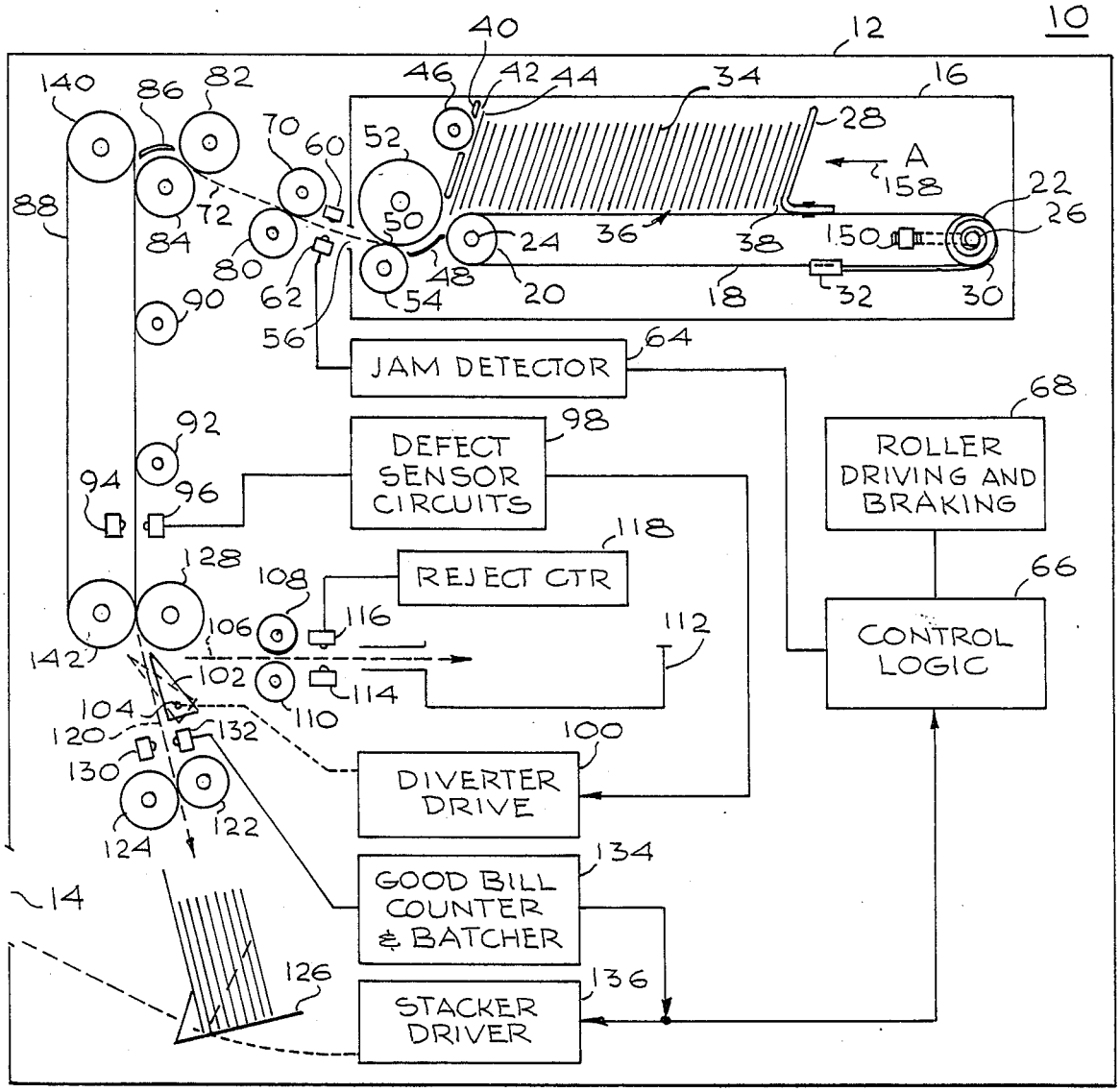
FIG. 1 is a schematic mechanical drawing of a document handling machine according to this invention.

In FIG. 1, document and currency handling machine 10 includes a casing 12 which has an output aperture 14 therein. Supported within casing 12 is a cartridge 16, the function of which is to receive a volume of bills or documents to be counted and sorted and to present those bills or documents in a one-at-a-time fashion to two portions of the document or bill handling machine 10 which perform the functions of sensing a defective bill or document, diverting the defective bill or document to a reject tray and collecting a pre-determined number of good bills or documents in an output stacker which, when the predetermined number of good bills or documents has been realized, is activated so that it is positioned to permit removal of a batched collection of good bills by the operator.

Figure 2:
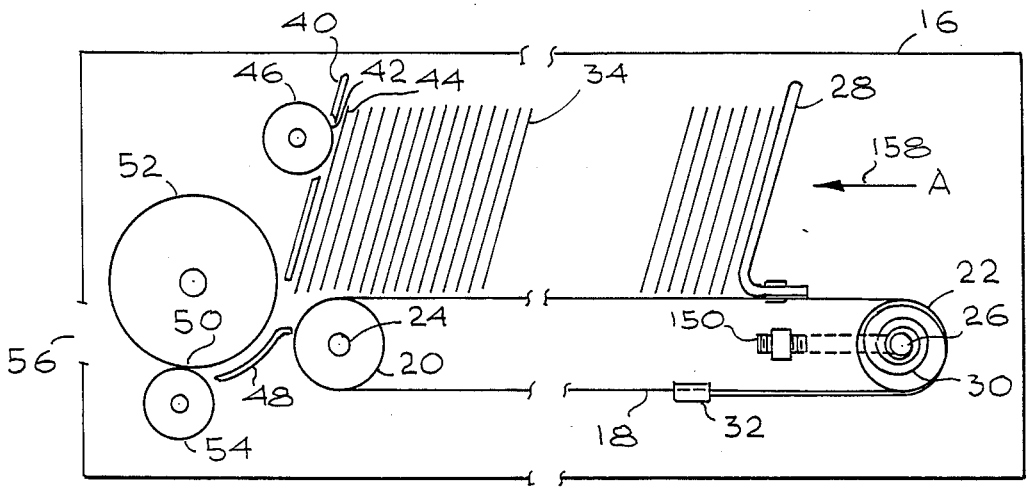
FIG. 2 is an enlarged schematic mechanical drawing of a portion of the device of FIG. 1; and, FIG. 3 is an enlarged schematic mechanical diagram of an additional portion of the document handling machine of FIG. 1.

Within cartridge 16 there is an endless belt 18 which is carried by a pair of rollers 10 and 22 on shafts or axles 24 and 26, respectively. A pusher plate 28 is supported on belt 18 to move therewith. As can be seen more clearly in FIG. 2, a spiral spring 30 is fixed at one end to shaft 26 and at the other end through coupling 32 to endless belt 18. As can be seen in FIGS. 1 and 2, documents or currency 34 is stacked with the individual bills being substantially vertical in orientation, with result that the stack is a horizontally disposed stack 36 which is engaged at one end 38 by pusher plate 28 and urged towards tray plate 40 which has an opening 42, therein, to permit engagement of the end-most bill or document 44 by picker roller 46 which is revolving in such a direction as to urge end-most bill 44 downwardly. As bill 44 moves downwardly it engages apron 48 which guides bill 44 into the interface region 50 between main feed roller 52 and pressure roller 54. Ultimately, bill 44 is feed out of cartridge 16 through aperture 56 for further handling to be described hereinafter. The path of bill 44 as it emerges from aperture 56 is shown by the dotted line in FIG. 1.

As can be seen from FIG. 1, bill 44 will first pass a sensor comprising, for example, a source of light 60 which is aimed at a photocell or photodiode 62 the output of which is coupled to a jam detector 64. Jam detector 64 takes the pulses which occur between successive bills being fed out of cartridge 16 and determines whether the spacing of the bills is appropriate or whether there has been an overlap between successive bills. If there has been an overlap, the time between pulses received by jam detector 64 will be excessively long and will indicate that overlapping or chaining of bills has occurred. If such phenomenon occurs a warning signal is transmitted out of jam detector 64 to control logic 66 which activates roller driving and braking circuits 68, thus resulting in the cessation of drive to drive rollers 52 and 70 so that no further bills are fed along path 72 into the sorting and batching mechanism which follows and which will now be described.

If the spacing between successive bills is adequate, each bill will pass between drive roller 70 and its idler roller 80 and move along path 72 to be picked up by the combination of drive roller 82 and its idler roller 84 where it is caused by deflector apron 86 to be diverted onto endless belt 88 along which it moves with the assistance of idler rollers 90 and 92 past a defect sensor comprising, for example, a light source 94 and a photodiode 96, such combination being useful in detecting adequate density or excessive density in the bill which is passing. Other defects, such as failure to carry magnetic ink may be detected at this point, as well as inappropriate density and such information is fed into defect sensor circuits 98 which develop a signal, in the event of a defective bill, which is utilized to trigger diverter drive 100. Drive 100 is coupled electromechanically to diverter 102 which is, in the presence of a defective bill, caused to rotate about axis 104 to the dotted-line position shown in FIG. 1 and in FIG. 3. With diverter 102 in the rotated position, the bill which has been determined to be defective is diverted along path 106 and is picked up by the combination of drive roller 108 and pressure roller 110 so as to be moved into rejector box 112. In the course of passing from the rollers 108, 110 to rejector box 112 the defective bill passes a sensor comprising a light source 114 and a photodiode 116 so that an output pulse is developed each time a bill moves into the rejector box. Such output pulse is counted in reject counter 118, and also triggers the return of diverter 102 to its position in line with the path of bills from the second endless belt 88 to the output rollers 122, 124.

If a bill 44 is good, diverter 102 is not activated and remains in the neutral position shown in solid lines in FIG. 1. The bill then moves along path 120 to be picked up by a combination of feed roller 122 and pressure roller 124 for feeding into stacker 126. The bill is urged out of contact with endless belt 88 and into the control of the combination of rollers 122 and 124, by feed roller 128. In the passing of bill 44 from the control of feed roller 128 and into the control of rollers 122 and 124 the bill passes a counter, which may be photoelectric counter comprising a light source 130 and a photodiode 132. Each time the light is interrupted by a passing good bill a pulse is generated by photocell or photodiode 132 and is fed to a good bill counter and batcher 134. Internal to good bill counter and batcher 134 are counting and comparator circuits which are well known in the art and need not be described here. Control logic 66 provides to counter and batcher 134 an appropriate signal which establishes what is the proper number of bills to complete a batch. When that level has been reached a signal is generated by counter and batcher 134 and passes to stacker driver 136 which electromechanically tilts stacker 126 from the solid line position shown in FIG. 1 to the dotted line position also shown in FIG. 1. In this dotted line position it is possible for the operator of the machine to remove the batch of a predetermined number of bills, such removal being through aperture 14 in case 12.

Figure 3:
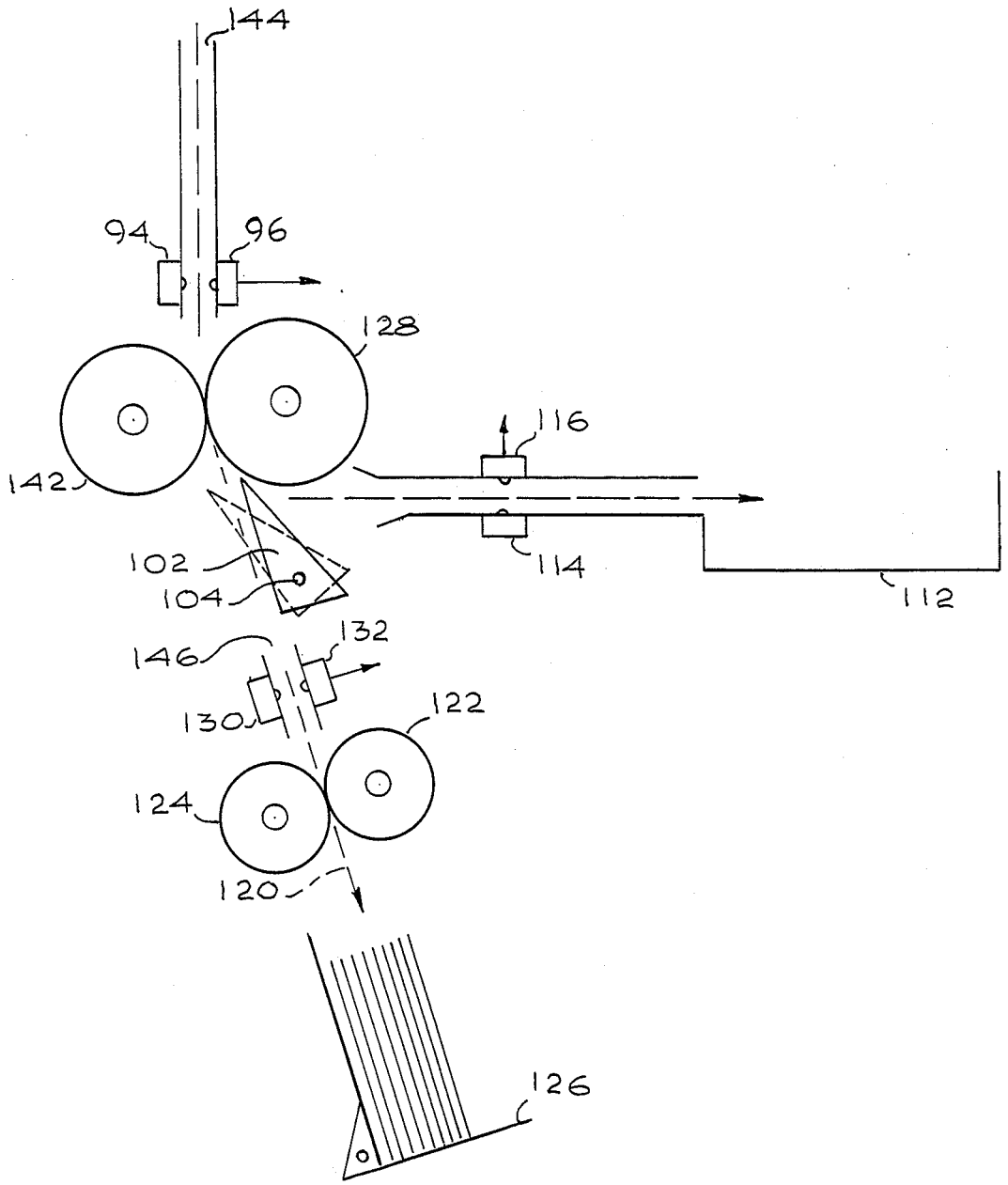

It is to be noted that endless belt 88 moves around rollers 140 and 142 and that channels 144 and 146, which appear in FIG. 3, may be provided to guide bill 44 and its successor bills in their travels through the machine. Belt 88 may be driven by feed roller 128 which is in frictional contact with belt 88 and roller 142. If rollers 140 and 142 are free-wheeling, they may be caused to rotate by the feed roller 128 and its frictional contact with belt 88 which interlinks rollers 140 and 142.

Fixed tensioning of endless belt 18 may be achieved by means of screw adjustment 150 which varies the separation between axis 24 of roller 20 and axis 26 of roller 22.

The document and currency handling machine according to this invention operates as follows.

A quantity of bills to be sorted and batched is placed in cartridge 16 by moving pressure plate 28 away from plate 40 and inserting the bills or documents in a semi-vertical position, as shown in FIG. 1. As pressure plate 28 is moved away from plate 42, to admit the bills, belt 18 is caused to move about roller 22 in a direction opposite to the direction A of arrow 158 in FIG. 1. Because of the connection of coil spring 32 belt 18 at coupler 32 and, since the opposite end of coil spring 30 is connected to shaft 26 of roller 22, coil spring 30 is caused to tighten-up so that it has stored spring energy proportional to the displacement of pusher plate 28 in a direction opposite to the direction of arrow 158. With cartridge 16 thus loaded it is put into machine 10 in the position shown in FIG. 1. Appropriate drive energy for feed roller 52 is automatically interconnected between the source of the drive and feed roller 52 upon the insertion of cartridge 16 in machine 10. This can be achieved by any one of a number of well-known techniques, either mechanical or electrical, and those techniques need not be described here.

Control logic 66 is then set for a given number of bills that it is desired to be in a batch, for example 100. That number is inserted in control logic 66 and when a total count of, for example, 100 bills, is achieved in counter and batcher 134 it sends a signal to control logic 66 which is compared with the set batch size and when they agree a signal is sent from control logic 66 to roller driving and braking module 63 which stops the driving of rollers 52, 70, 82, 128 and 122. Simultaneoulsy, a drive signal is sent to stacker/driver 136 causing it to tilt to the dotted line position shown in FIG. 1 so that the batch of bills may be easily removed and strapped. The circuits for achieving the counting, roller driving and braking control and defect sensing as well as that for driving stacker/driver 136 are all well-known and need not be dealt with in detail here.

Thus, there has been provided a document and currency handling machine which achieves sorting and batching with maximum speed, reliability and convenience.

While a particular embodiment of this invention has been shown and described, it will be apparent to those skilled in the art that variations and modifications may be made in the described structure without departing from the spirit or scope of the invention. It is the purpose of the appended claims to cover all such variations and modifications.

What is claimed is:

1. A document and currency handling machine which includes:

a document input mechanism including a first endless belt linking first and second rollers, each roller having an axle;

a pusher plate supported on said first endless belt for movement therewith;

a fixed plate supported in said input mechanism in opposition to said pusher plate, said fixed plate having a picker opening therethrough;

a coil spring coupled between said endless belt and said axle of said second roller for biasing said pusher plate towards said fixed plate;

said pusher plate and said fixed plate being adapted for the insertion therebetween of documents to be handled;

a picker roller positioned to protrude through said picker opening to contact any document pushed thereagainst by said pusher plate and to move any such document out of the space between said pusher plate and said fixed plate;

a document transporting mechanism including a second endless belt;

third and fourth rollers linked by second endless belt;

moving means for moving said documents along said second endless belt;

a defect sensor positioned along said second endless belt in the path of said documents to be handled, said defect sensor producing a defect output signal when a defective bill passes said defect sensor;

fifth and sixth output rollers in pressured contact with each other and positioned along the path of said documents to be handled after said second endless belt;

a diverter positioned along the path of said documents to be handled, after said endless belt and before said fifth and sixth rollers;

a stacker, rotatable from a position in line with the path of said documents to be handled to an output position;

a rejected document container positioned out of the paths, from said second endless belt to said stacker but in a position to cooperate with said diverter;

said diverter being responsive to said defect output signal from said defect sensor to divert said documents to be handled from the path to said stacker to the path to said rejected document container.

2. Apparatus according to claim 1 which includes, in addition, counting means for counting documents moving into said stacker and additional means responsive to the counting by said counting means of a predetermined number of documents moved into said stacker to produce a batch signal;

means responsive to said batch signal for moving said stacker from said position in line with the path of said documents to said output position.

3. Apparatus according to claim 1 which includes, in addition, means for counting the number of rejected documents.

4. Apparatus according to claim 2 which includes means for returning said diverter to a position in line with said path of said documents after a defective document has been diverted.

5. Apparatus according to claim 2 which includes, in addition, means responsive to said batch signal to stop the movement of said documents to be handled out of said document input mechanism.

6. Apparatus according to claim 1 including, in addition, means for tensioning said first endless belt.

* * * * *